US007317375B2

(12) United States Patent
Yu

(10) Patent No.: US 7,317,375 B2
(45) Date of Patent: Jan. 8, 2008

(54) ADJUSTABLE SAFETY SWITCH

(76) Inventor: Tsung-Mou Yu, No. 4, Alley 2, Lane 23, Sec. 3, Pa Te Road, Panchiao, Taipei (TW)

( * ) Notice: Subject to any disclaimer, the term of this patent is extended or adjusted under 35 U.S.C. 154(b) by 349 days.

(21) Appl. No.: 11/093,214

(22) Filed: Mar. 29, 2005

(65) Prior Publication Data

US 2006/0220779 A1 Oct. 5, 2006

(51) Int. Cl.
*H01H 37/70* (2006.01)
*H01H 37/52* (2006.01)
*H01H 37/18* (2006.01)

(52) U.S. Cl. ..... 337/94; 337/56; 337/66

(58) Field of Classification Search ..... 337/56, 337/72, 66, 94; 200/339, 341
See application file for complete search history.

(56) References Cited

U.S. PATENT DOCUMENTS 3,932,829 A * 1/1976 Ellenberger ..... 337/49
4,258,349 A * 3/1981 Flory ..... 337/46
4,329,669 A * 5/1982 Krasser et al. ..... 335/20
4,338,586 A * 7/1982 Scanlon ..... 337/74
4,345,233 A * 8/1982 Matthies ..... 337/75
4,528,538 A * 7/1985 Andersen ..... 337/43
4,833,439 A * 5/1989 Bowden et al. ..... 337/68
4,922,219 A * 5/1990 Bakhaus et al. ..... 337/74
5,089,799 A * 2/1992 Sorenson ..... 337/68
5,223,813 A * 6/1993 Cambreleng et al. ..... 337/66
5,262,748 A * 11/1993 Tsung-Mou ..... 337/66
5,264,817 A * 11/1993 Sorenson ..... 337/68
5,491,460 A * 2/1996 Krasser et al. ..... 337/70
5,539,371 A * 7/1996 Yu ..... 337/66
5,760,672 A * 6/1998 Wang ..... 337/79
5,892,426 A * 4/1999 Huang ..... 337/59
6,275,134 B1 * 8/2001 Chen ..... 337/37
6,307,460 B1 * 10/2001 Yu ..... 337/37
6,400,250 B1 * 6/2002 Wang ..... 337/66
6,445,273 B1 * 9/2002 Yu ..... 337/37
6,456,185 B1 * 9/2002 Yu ..... 337/37
6,512,441 B1 * 1/2003 Yu ..... 337/37
6,525,639 B1 * 2/2003 Cheng ..... 337/37
6,552,644 B2 * 4/2003 Yu ..... 337/66
6,563,414 B2 * 5/2003 Yu ..... 337/66
6,577,221 B1 * 6/2003 Wang ..... 337/59
6,617,952 B1 * 9/2003 Yu ..... 337/94
6,621,402 B2 * 9/2003 Huang ..... 337/66
6,664,884 B1 * 12/2003 Yu ..... 337/59
6,674,033 B1 * 1/2004 Wang ..... 200/334

(Continued)

FOREIGN PATENT DOCUMENTS

FR 2605142 A1 * 4/1988

*Primary Examiner*—Anatoly Vortman

(57) ABSTRACT

A switch device includes a body with a switch member pivotably engaged with a top opening of the body and a first terminal and a second terminal respectively extend through two slots in a bottom of the body. A connection member is fixedly connected to an inside of the body and an adjusting member movably extends through a wall of the body and contacts the connection member. A U-shaped biasing member has a first end connected to the second end of a bi-metallic plate and a second end of the biasing member is connected to the connection member. The biasing member provides the bi-metallic plate proper flexibility so as to ensure the deformation of the bi-metallic plate to cut off the switch device when it is overloaded.

8 Claims, 3 Drawing Sheets

U.S. PATENT DOCUMENTS 6,714,116 B1 * 3/2004 Sang et al. ..... 337/68
6,734,779 B2 * 5/2004 Yu ..... 337/59
6,788,186 B1 * 9/2004 Yu ..... 337/66
6,864,453 B1 * 3/2005 Yu ..... 200/520
6,940,389 B1 * 9/2005 Yu ..... 337/66
7,030,726 B2 * 4/2006 Yu ..... 337/66
2003/0160679 A1 * 8/2003 Yu ..... 337/37
2005/0140489 A1 * 6/2005 Kuo ..... 337/66

* cited by examiner (OFF)

(ON)

ADJUSTABLE SAFETY SWITCH

FIELD OF THE INVENTION

The present invention relates to a safety switch including an adjusting assembly connected to the bi-metallic plate of the safety switch so as to ensure that the bi-metallic plate is deformed as desired when it is overloaded.

BACKGROUND OF THE INVENTION

A conventional switch device, especially for those switches using a bimetallic plate to prevent from being burned when it is overloaded, generally includes a bi-metallic plate which is deformed when the switch device is overloaded so as to separate the two contact points respectively located on the bi-metallic plate and one of the two terminals of the switch device. Some inherent shortcomings for these conventional safety switch devices are found. There are too many parts involved in the safety switch device and a longer period of time is required when assembling the switch device, and this increases the cost of the products. The parts might be arranged inaccurately and affect the deformation of the bi-metallic plate. Once the bi-metallic plate is deformed to cut off the circuit, because of the improper arrangement of the parts as mentioned above, the bi-metallic plate could deform to re-connect the two contact points to connect the circuit again. Because of the inaccuracy of the deformation of the bi-metallic plate, the switch member does not set the "OFF" position properly after the bi-metallic plate is deformed to cut off the circuit.

Therefore, it is desired to have a safety switch wherein the bi-metallic plate is ensured to have proper flexibility and deformed to separate the two contact points when the safety switch is overloaded.

SUMMARY OF THE INVENTION

In accordance with an aspect of the present invention, there is provided a switch device that comprises a body with a top opening with which a switch member is pivotably engaged, two slots are defined through an underside of the body so that a first terminal and a second terminal respectively extend through the two slots. A first contact point is connected to the second terminal. A bimetallic plate has a first end fixed to the first terminal and a second contact point is connected to an underside of a second end of the bimetallic plate. The second contact point is located above the first contact point. A link has an upper end pivotably connected to the switch member and a lower end of the link clamps the second end of the bimetallic plate. An adjusting assembly includes a connection member fixedly connected to an inside of the body and an adjusting member movably extends through a wall of the body and contacts the connection member. A biasing member has a first end connected to the second end of the bimetallic plate and a second end of the biasing member is connected to the connection member.

The main object of the present invention is to provide a safety switch that uses an adjusting assembly, which adjusts the curvature of the biasing member so that the bimetallic plate is ensured to be deformed toward desired direction to cut the circuit.

Another object of the present invention is to provide a safety switch that includes a less number of parts so as to have lower manufacturing cost.

The present invention will become more obvious from the following description when taken in connection with the accompanying drawings, which show, for purposes of illustration only, a preferred embodiment in accordance with the present invention.

DETAILED DESCRIPTION OF THE PREFERRED EMBODIMENT

Figure 1:
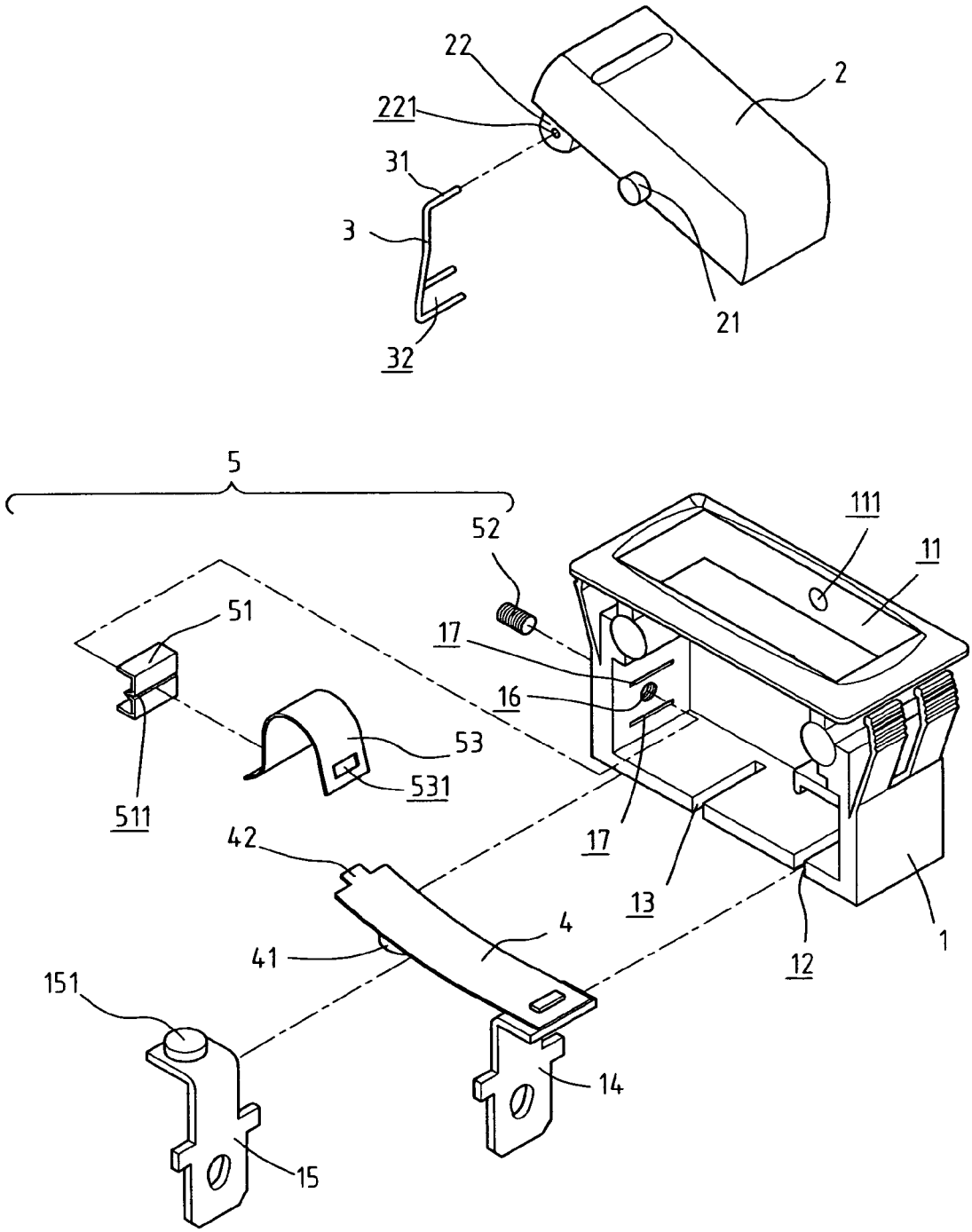
FIG. 1 is an exploded view of a safety switch device in accordance with the present invention.
Figure 2:
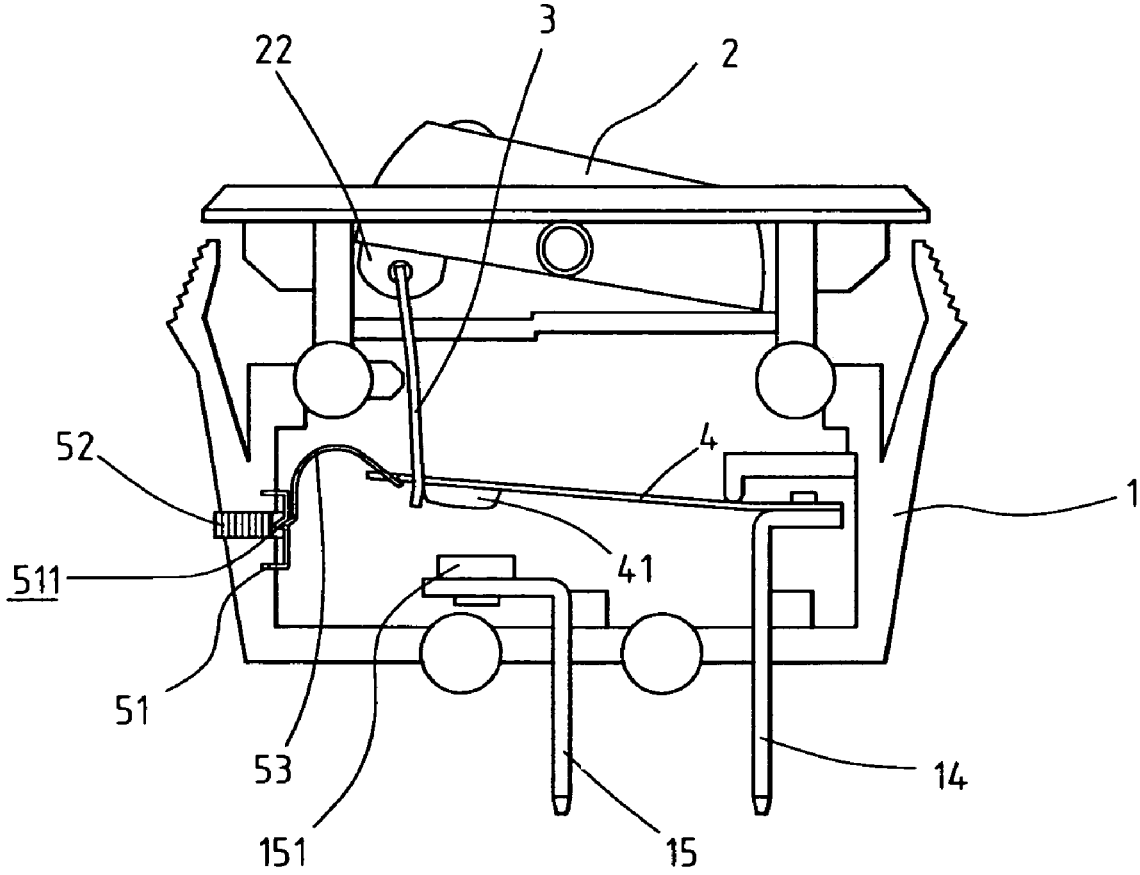
FIG. 2 shows the bimetallic plate is in "OFF" position of the safety switch of the present invention.
Figure 3:
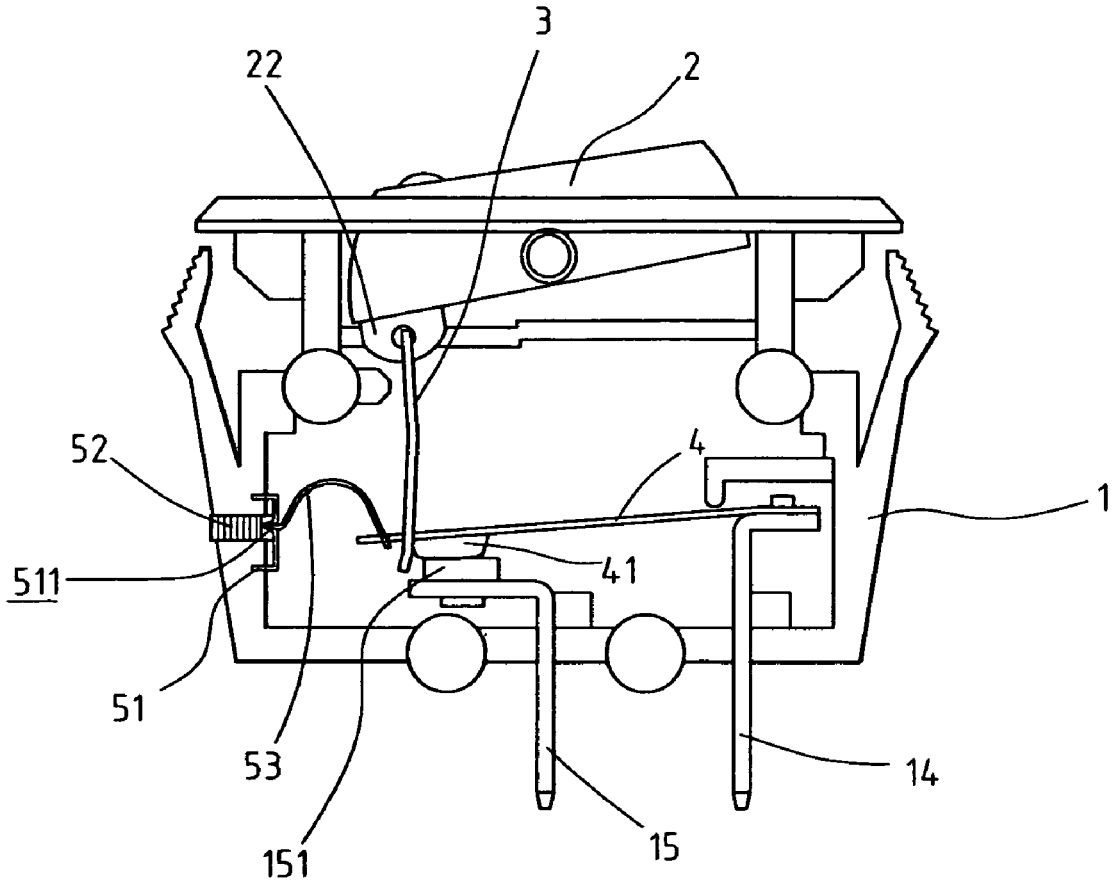
FIG. 3 shows the bimetallic plate is in "ON" position of the safety switch of the present invention.

Referring to the drawings and in particular FIGS. 1-3, a safety switch device comprises a body 1 with a top opening 11 and two pivot holes 111 are defined through two opposite walls of the body 1. A switch member 2 is pivotably engaged with the top opening 11 of the body 1 by pivotally engaging two pivots 21 extending from two sides of the switch member 2 with the two pivot holes 111. A protrusion 22 extends from an underside of an end of the switch member 2 and includes a receiving hole 221. Two slots 12, 13 are defined through an underside of the body 1 so that a first terminal 14 and a second terminal 15 respectively extend through the two slots 12, 13. A first contact point 151 is connected to the second terminal 15. A bimetallic plate 4 has a first end fixed to a top of the first terminal 14 and a second contact point 41 connected to an underside of a second end of the bimetallic plate 4. The second contact point 41 is located above the first contact point 151. Two slits 17 are defined in an inside of the body 1 and a through hole 16 is defined through a wall of the body 1 and located between the two slits 17.

A link includes an upper end which is pivotably engaged with the receiving hole 221 in the protrusion 22 of the switch member 2 and a lower end of the link 3 includes two bars between which a space 32 is defined. The second end of the bimetallic plate 4 is clamped in the space 32.

An adjusting assembly 5 includes a connection member 51, a biasing member 53, and an adjusting member 52. The connection member 51 is an E-shaped member and the upper and lower extensions of the E-shaped connection member 51 are engaged with the slits 17 and the adjusting member 52 such as a bolt movably extends through the through hole 16 and contacts the connection member 51. The biasing member 53 is a U-shaped plate and the first end of the biasing member 53 includes a through hole 531 and the second end of the bi-metallic plate 4 includes a tongue 42 which is engaged with the through hole 531. A second end of the biasing member 53 is inserted in the engaging slit 511 of the connection member 51. As can be seen from FIGS. 1 and 2, the engaging slit 511 is formed on a plate portion of the connection member 51 for receiving the second end of the biasing member 53 from one side of the plate portion, and the adjusting member 52 pushes the connection member 51 against the biasing member 53 from the other side of the plate portion.

As shown in FIGS. 2 and 3, when the switch device is in "ON" position, the left end of the switch member 2 is pushed and the second end of the bi-metallic plate 4 is pushed downward by the lower end of the link 3. The first and second contact points 41, 151 are in contact with each other so that the circuit is in "ON" status. When the switch device is in "ON" position and overloaded, the bi-metallic plate 4 is deformed upward and the first and second contact points 41, 151 are separated so that the circuit is cut off. The biasing member 53 ensures that the bi-metallic plate 4 has a sufficient force to be deformed as desired. The curvature of the biasing member 53 can be adjusted by moving the adjusting member 52 to move the connection member 51 toward the biasing member 53 or to move in a direction away from the biasing member 53. When the right end of the switch member 2 is pushed, the second end of the bi-metallic plate 4 is lifted by the lower end of the link 3 and the first and second contact points 41, 151 are separated so that the circuit is in "OFF" status.

While we have shown and described the embodiment in accordance with the present invention, it should be clear to those skilled in the art that further embodiments may be made without departing from the scope of the present invention.

What is claimed is:

1. A switch device comprising:

a body with a top opening and two slots defined through an underside of the body, a first terminal and a second terminal extending through the two slots and a first contact point connected to the second terminal;

a bi-metallic plate having a first end fixed to the first terminal and a second contact point connected to an underside of a second end of the bi-metallic plate, the second contact point located above the first contact point;

a switch member pivotably engaged with the top opening of the body;

a link having an upper end pivotably connected to the switch member and a lower end of the link clamping the second end of the bimetallic plate, and an adjusting assembly including a connection member fixedly connected to an inside of the body and an adjusting member movably extending through a wall of the body and contacting the connection member, a biasing member having a first end connected to the second end of the bi-metallic plate and a second end of the biasing member being connected to the connection member;

wherein the connection member has a plate portion formed with at least an engaging slit for receiving the second end of the biasing member from one side of the plate portion, and the adjusting member pushes the connection member against the biasing member from the other side of the plate portion.

2. The device as claimed in claim 1, wherein a protrusion extends from an underside of an end of the switch member and includes a receiving hole, the upper end of the link extends pivotably in the receiving hole.

3. The device as claimed in claim 1, wherein the lower end of the link includes two bars between which a space is defined, the second end of the bimetallic plate is clamped in the space.

4. The device as claimed in claim 1, wherein two pivot holes are defined through two opposite walls of the body and two pivots extend from two sides of the switch member, the two pivots are pivotably engaged with the two pivot holes.

5. The device as claimed in claim 1, wherein a through hole defined through the inside of the body and at least one slit defined in the inside of the body, the connection member is engaged with the at least one slit and the adjusting member movably extends through the through hole.

6. The device as claimed in claim 1, wherein the adjusting member is a bolt.

7. The device as claimed in claim 1, wherein the biasing member is a U-shaped plate.

8. The device as claimed in claim 1, wherein the first end of the biasing member includes a through hole and the second end of the bi-metallic plate includes a tongue which is engaged with the through hole.

* * * * *